US007954567B2

(12) United States Patent
Haughom

(10) Patent No.: US 7,954,567 B2
(45) Date of Patent: Jun. 7, 2011

(54) ADJUSTABLE WINGED CENTERING TOOL FOR USE IN PIPES WITH VARYING DIAMETER

(75) Inventor: Per Olav Haughom, Tonstad (NO)

(73) Assignee: I-Tec AS, Stavanger (NO)

( * ) Notice: Subject to any disclaimer, the term of this patent is extended or adjusted under 35 U.S.C. 154(b) by 192 days.

(21) Appl. No.: 11/988,539

(22) PCT Filed: Jul. 28, 2006

(86) PCT No.: PCT/NO2006/000290

§ 371 (c)(1),
(2), (4) Date: Jul. 9, 2008

(87) PCT Pub. No.: WO2007/015647

PCT Pub. Date: Feb. 8, 2007

(65) Prior Publication Data

US 2008/0296067 A1 Dec. 4, 2008

(30) Foreign Application Priority Data

Aug. 1, 2005 (NO) ..... 20053684

(51) Int. Cl.
*E21B 17/10* (2006.01)

(52) U.S. Cl. ..... 175/325.4; 175/325.5; 166/241.6

(58) Field of Classification Search ..... 166/241.6, 166/241.7; 175/320, 325.1, 325.5, 325.6
See application file for complete search history.

(56) References Cited

U.S. PATENT DOCUMENTS

| | | | | |
|---|---|---|---|---|
| 1,910,123 | A * | 5/1933 | Reisinger | 408/171 |
| 2,389,906 | A * | 11/1945 | Heard | 166/241.2 |
| 2,427,052 | A | 9/1947 | Grant | |
| 3,282,349 | A * | 11/1966 | Cobbs et al. | 166/241.6 |
| 3,545,825 | A | 12/1970 | Hamilton | |
| 4,106,823 | A | 8/1978 | Bassinger | |
| 4,798,246 | A * | 1/1989 | Best | 166/311 |
| 5,332,048 | A | 7/1994 | Underwood et al. | |
| 5,487,426 | A * | 1/1996 | O'Hair | 166/378 |
| 5,931,239 | A | 8/1999 | Schuh | |
| 6,494,272 | B1 | 12/2002 | Eppink et al. | |
| 7,048,064 | B1 * | 5/2006 | Smith | 166/382 |

FOREIGN PATENT DOCUMENTS

| | | |
|---|---|---|
| EP | 0 594 418 | 4/1994 |
| GB | 2 277 336 | 10/1994 |

OTHER PUBLICATIONS

International Search Report mailed Nov. 14, 2006 for International Application No. PCT/NO06/000290.

* cited by examiner

*Primary Examiner* — Kenneth Thompson
(74) *Attorney, Agent, or Firm* — Wenderoth, Lind & Ponack, L.L.P.

(57) ABSTRACT

An adjustable centering tool for use in pipes of varying inner diameter. The centering tool being provided with a number of identical and steplessly adjustable, radially protruding wings having guiding lugs and chamfered end faces. The wings, having been set, are retained by an upper lock mandrel with a safety pin and a lower lock mandrel with a safety nut. The outer circumference of a cylindrical tool body is fitted with longitudinal grooves having sloped terminations cooperating with the wing dimensions, the chamfered end faces of the wings, and the guiding lugs.

11 Claims, 9 Drawing Sheets

ADJUSTABLE WINGED CENTERING TOOL FOR USE IN PIPES WITH VARYING DIAMETER

BACKGROUND OF THE INVENTION

I. Field of the Invention

The present invention relates to an adjustable centering tool for use in pipes of varying inner diameter.

II. Description of the Related Art

A centering tool is connected to various equipment and tools during work and measurement operations being carried out in an oil or gas well. Also, a verification of the inner diameter of the well is made using a centering tool, as well as of the existence/non-existence of obstructions in the wellbore.

Today, various centering tools are used for such tasks, each being adapted to the inner diameter of each well, and the contractor must hence know in advance the range of well diameters that are to be inspected and carry the appropriate tools for each of the dimensions in question.

U.S. Pat. No. 2,427,052 discloses a scraper tool in which a set of wings is forced outwards by pistons. The pistons and the wings have cooperative, sloped surfaces. By increasing the fluid pressure through the tool string the pistons are pressed against each other, forcing the wings outwards. A spring pulls the wings back to the starting position when the pressure on the pistons is removed.

U.S. Pat. No. 3,545,825 discloses a centering device for a drill string, the protruding wings of which may be adjusted and secured in position by screws.

U.S. Pat. No. 6,494,272 shows another example of wings that are forced outwards by supplying an additional fluid pressure.

BRIEF SUMMARY OF THE INVENTION

The present invention allows the above well operations to be carried out using one centering tool, said tool having a cylindrical shape and being provided with a number of, such as six, for example, synchronously and steplessly adjustable, radially outward protruding wings.

The present application provides a centering tool for use in pipes of varying inner diameter, said centering tool being characterized by the features set forth in the characteristics of the independent claims.

DETAILED DESCRIPTION OF THE INVENTION

Figure 1:
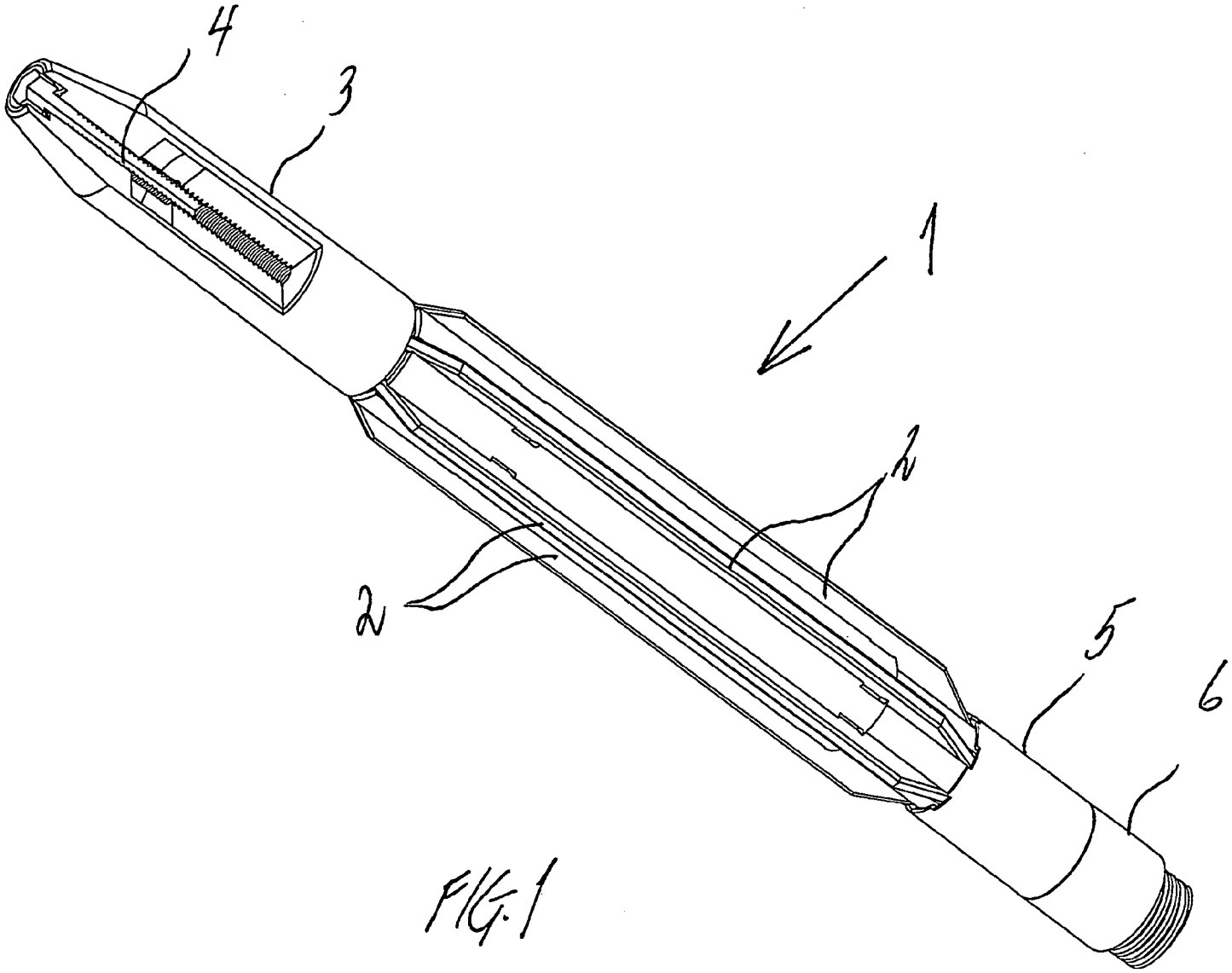
FIG. 1 shows a drawing of a centering tool according to the present invention.

FIG. 1 shows a 3D perspective view of a centering tool 1 having wings 2 being extended from their inner or retracted position in corresponding grooves. The position of wings 2 is retained by an upper lock mandrel 3 with a safety bolt 4 and a lower lock mandrel 5 with a safety nut 6.

Figure 2:
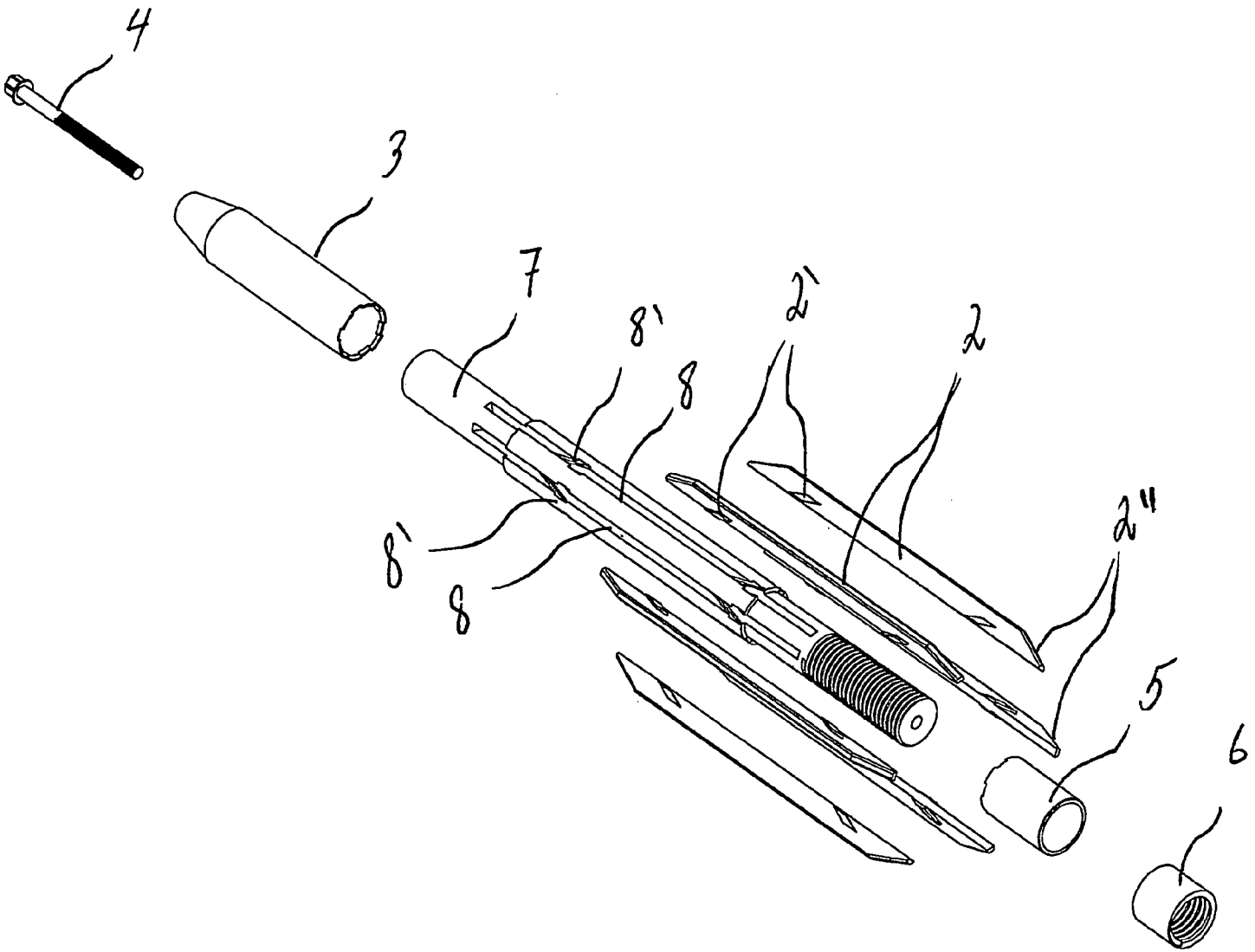
FIG. 2 shows an exploded view of the centering tool according to the present invention.

FIG. 2 shows a centering tool 1, the parts of which are pulled apart and shown separately; six wings 2, each having a number of, such as two, for example, pairs of guiding lugs 2' and chamfered end faces 2", an upper lock mandrel 3 with safety pin 4, and a lower lock mandrel 5 with safety nut 6. A cylindrical tool body 7 is, at its outer circumference, provided with longitudinal grooves 8 having sloped terminations 8' cooperative with the wing dimensions, the chamfered end faces 2" of the wings, and the guiding lugs 2', respectively.

Figures 3A, 3B, 3C:
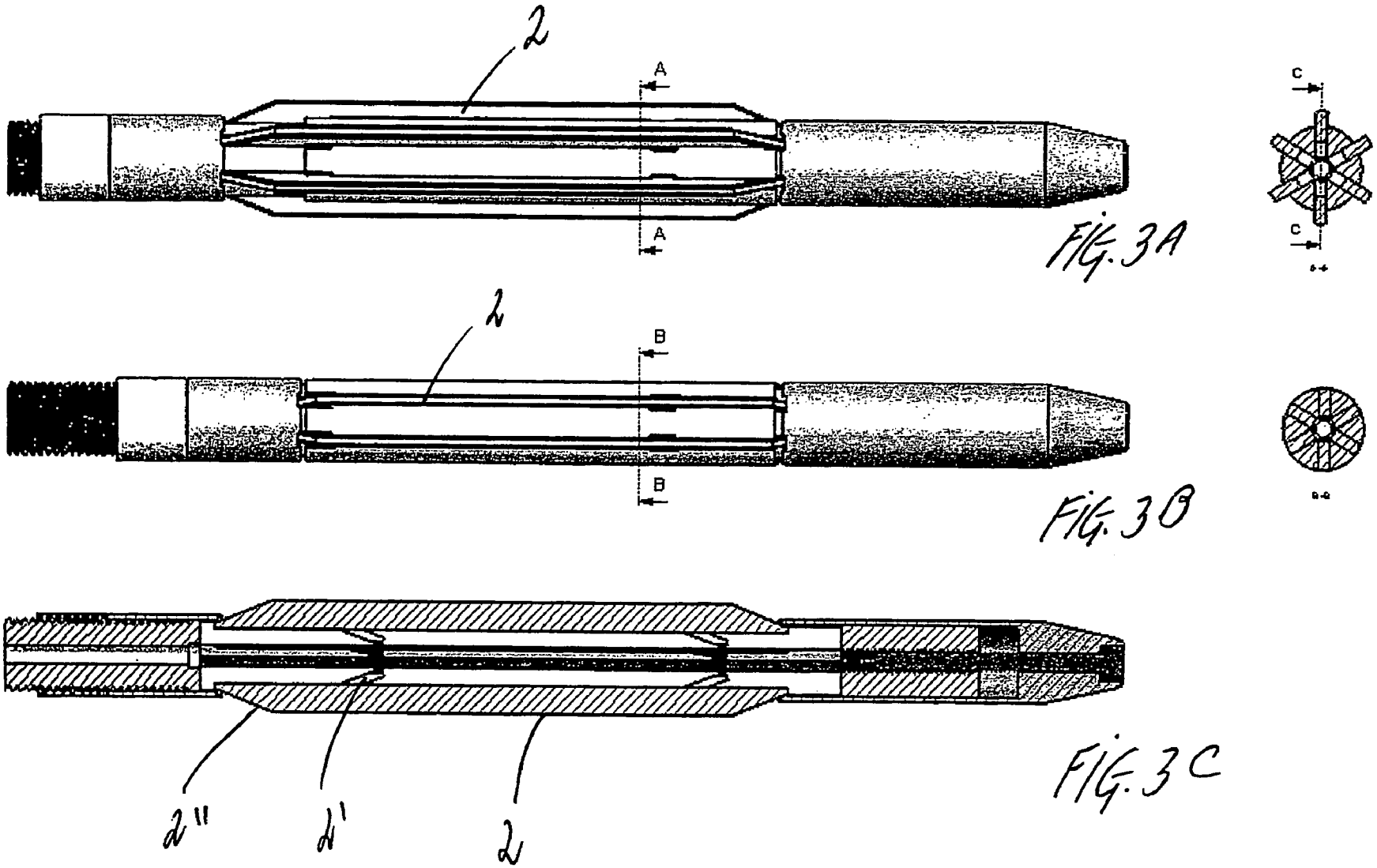
FIGS. 3A-B show the centering tool according to the present invention in different positions.
FIG. 3C shows a longitudinal section of the centering tool according to the present invention.

FIG. 3A shows a centering tool 1 in a side view with the wings 2 extended from the outer circumference of the tool body 7.

FIG. 3B shows a similar view with the wings 2 mounted in a retracted position being flush with the outer circumference of the tool body 7.

FIG. 3C shows a longitudinal section of the centering tool 1 wherein the wing 2 is mounted in the extended position in which the upper and lower lock mandrels 3 and 5 fix the two chamfered end faces 2" of the wing. The guiding lugs 2' have traveled in the grooves 8 of the tool body 7.

Figure 4:
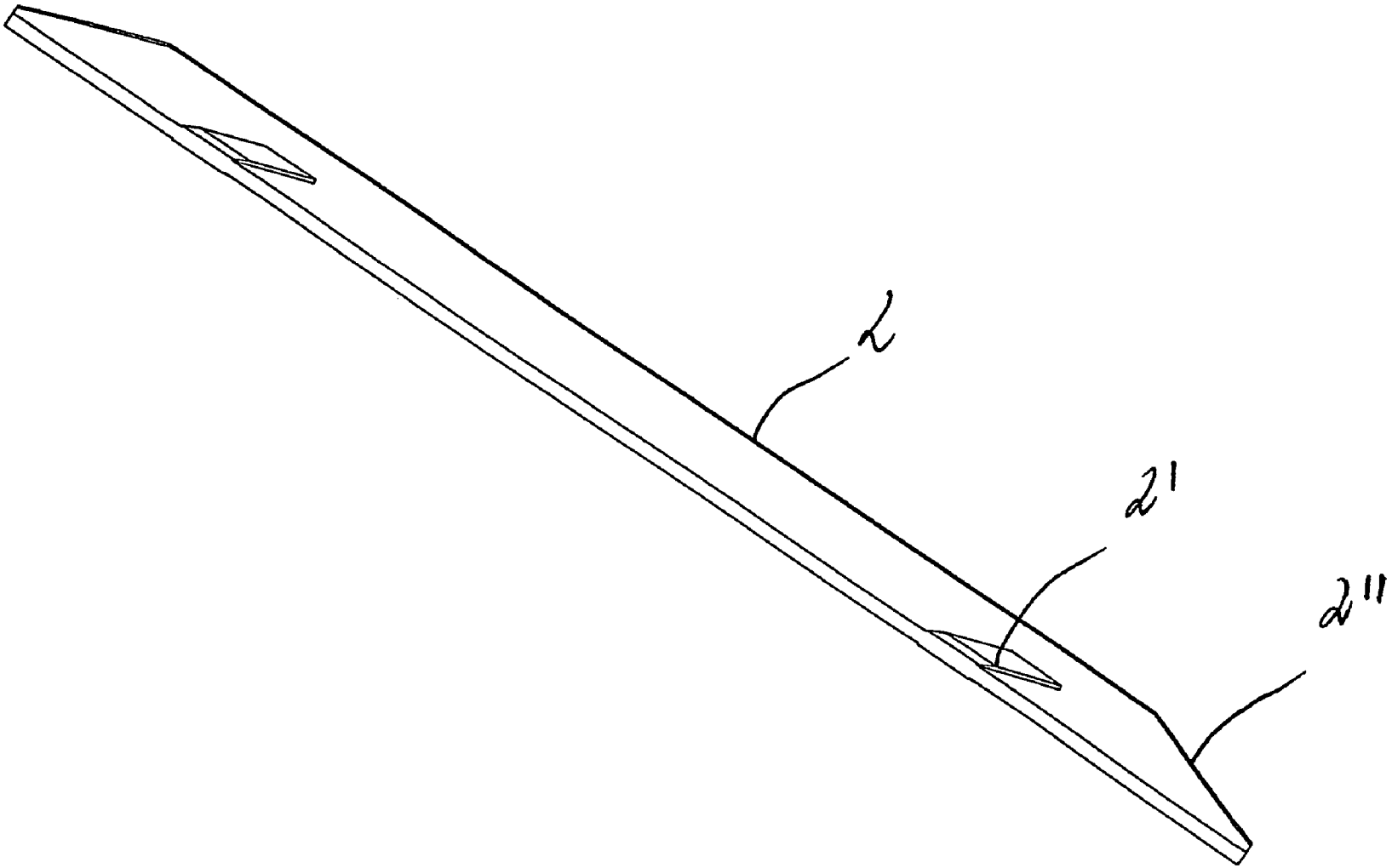
FIG. 4 shows a drawing of a wing according to the present invention.

FIG. 4 shows a 3D drawing of a wing 2 having guiding lugs 2' and chamfered end faces 2".

Figures 5A, 5B:
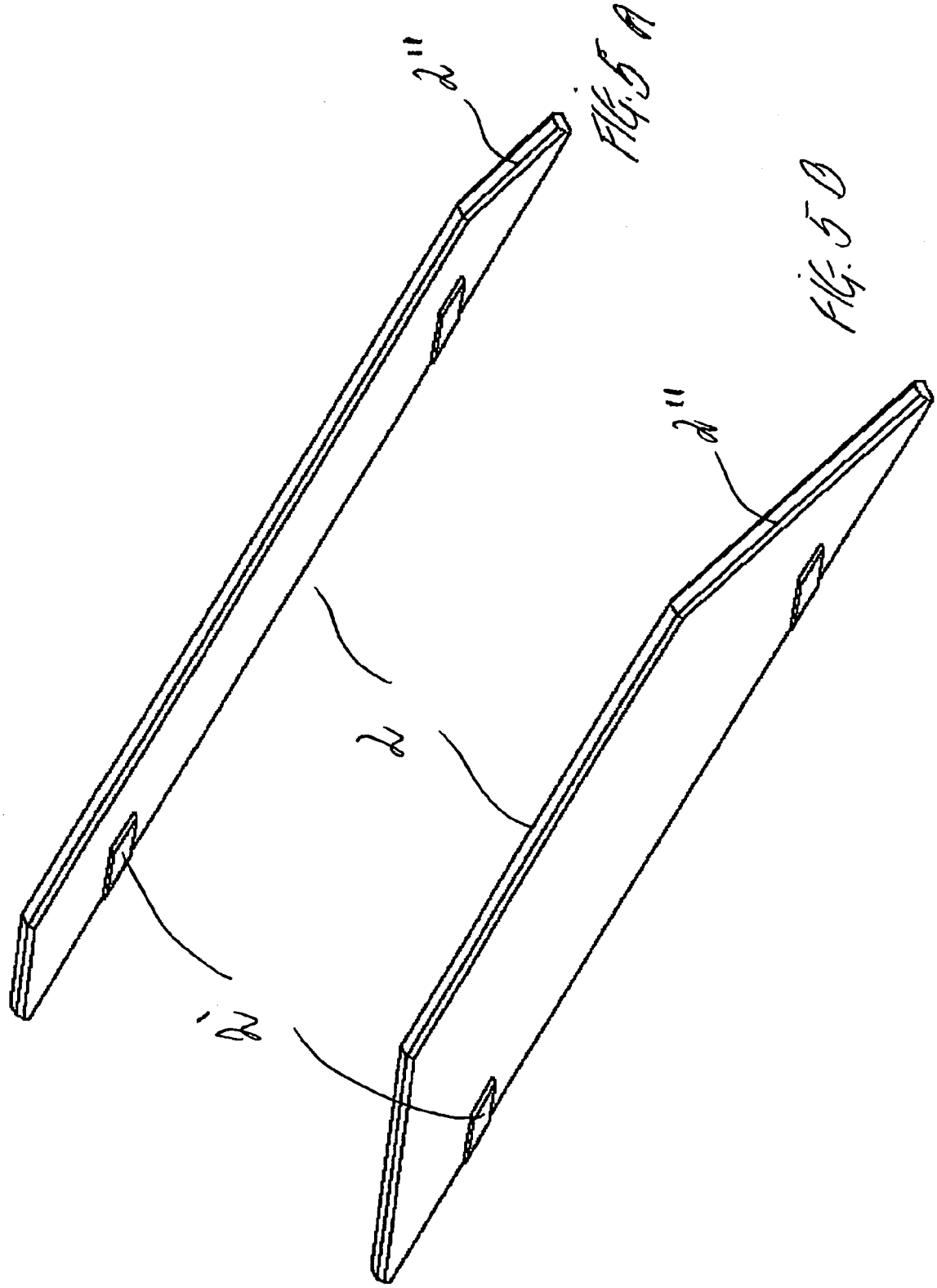
FIGS. 5A-B show drawings of different types of wings according to the present invention.

FIG. 5A shows a 3D drawing of a standard wing 2 having guiding lugs 2' and chamfered end faces 2".

FIG. 5B shows a 3D drawing of a replaceable wing 2 having the same length and same guiding lugs 2' as the one in the previous drawing but being broader and having longer chamfered end faces 2", hence being usable in wells having a larger than standard inner diameter.

Figures 6A, 6B:
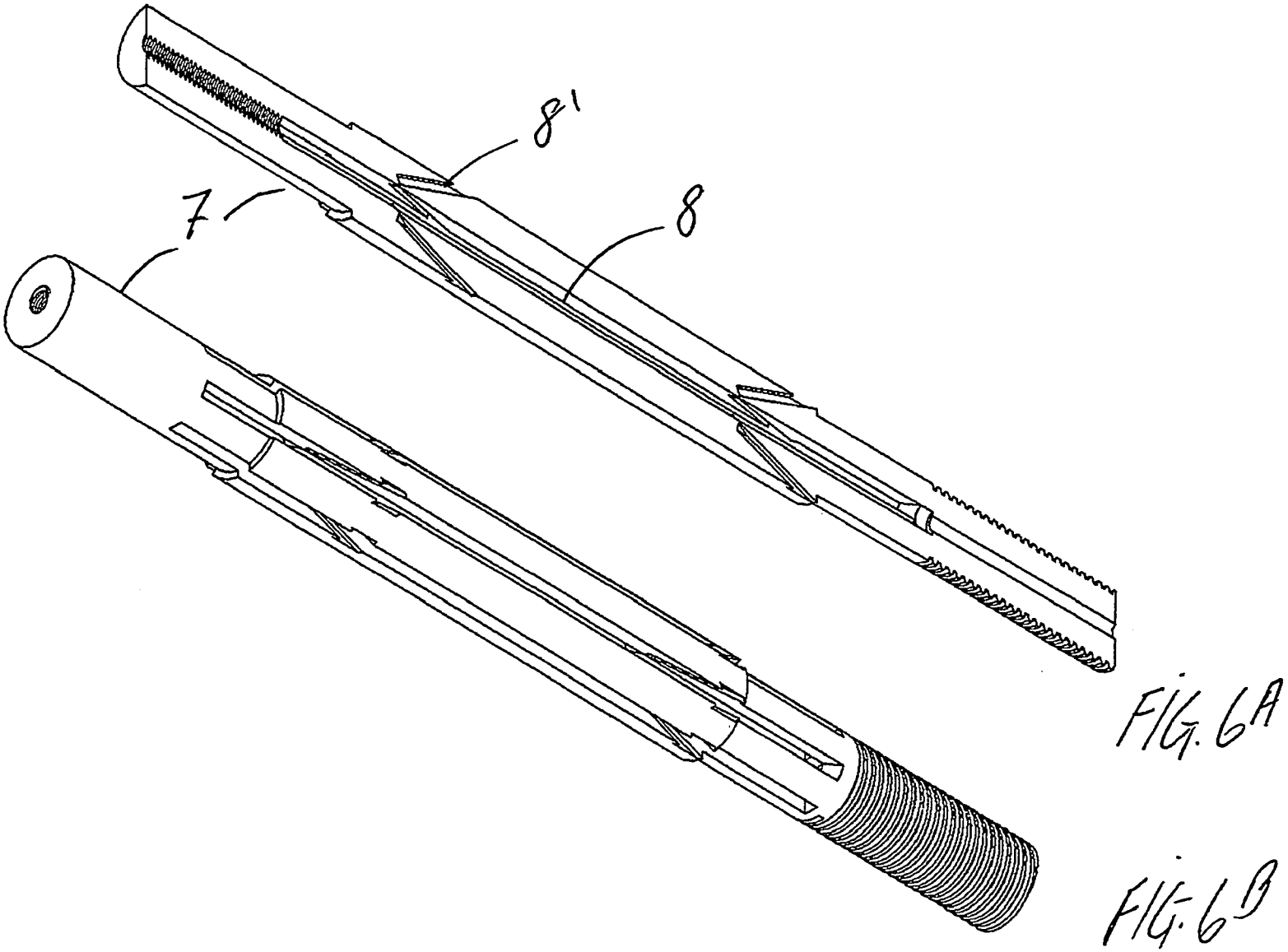
FIG. 6A shows one half of a split tool body according to the present invention.
FIG. 6B is similar to FIG. 6A, but the tool body is not split.

FIG. 6A shows one half of a split tool body 7 having longitudinal grooves 8 with sloped terminations 8' for the wing 2 and the guiding lugs 2'.

FIG. 6B shows a similar view, but the tool body is not split.

Figure 7:
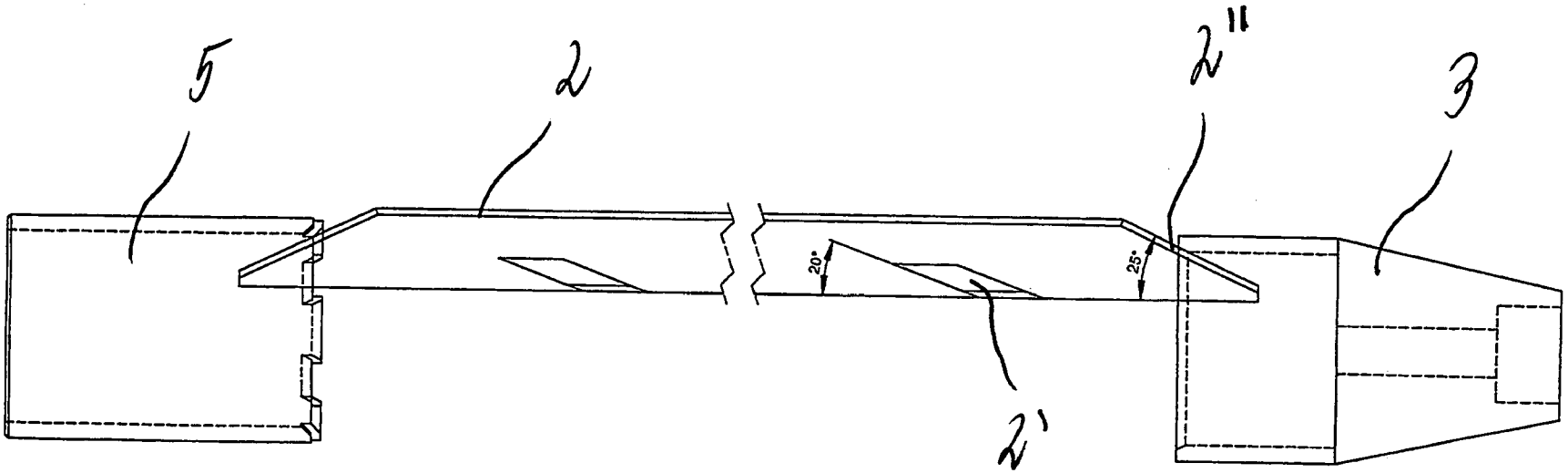
FIG. 7 shows a detailed side view of the centering tool according to the present invention.

FIG. 7 shows a side view of a wing 2 having guiding lugs 2' positioned at an angle of 20° to the axial direction, whereas the end faces 2" of the wing have an angle of 25° to the axial direction. Lower lock mandrel 5 prevents the wing 2 from traveling "outwards" while upper lock mandrel 3 prevents the wing 2 from traveling "inwards" as the chamfered end faces 2" have a steeper angle than that of the guiding lugs 2'.

The wings 2 of the centering tool 1 are pre-adjusted on the drilling floor in order to give it the desired outer dimensions as appropriate for the operation to be performed by the tool according to a given procedure.

Then the centering tool 1 is attached to a wireline and lowered down the tubing to the casing.

The design of the chamfered end faces 2" of the wings 2 with a given angle, such as 25°, for example, cooperates with the sloped terminations 8' of the longitudinal grooves 8 having a given angle, such as 20°, for example, helping the wings (2) slide in the sloped terminations 8' of the grooves 8 in which they may be synchronously locked in any position.

The centering tool is used for centering other equipment and tools, determining whether any obstructions exist in the well, and determining whether the wellbore diameter is constant or varies.

Figure 8:
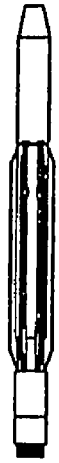
FIGS. 8-12 show various steps of a process for adjusting and setting the guiding wings of the centering tool according to the present invention.
Figure 9:
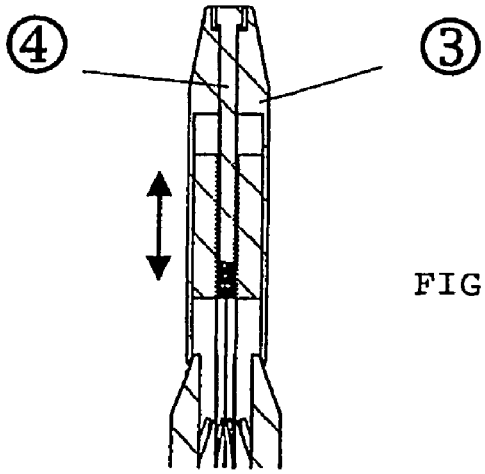
Figure 10:
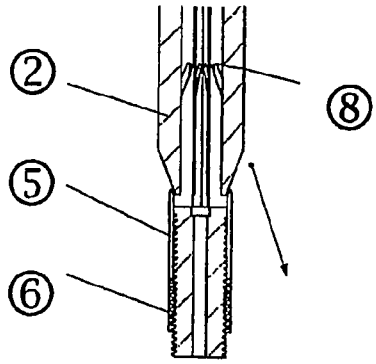
Figure 11:
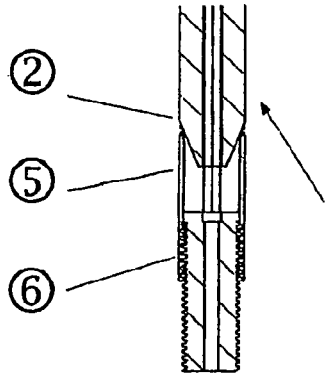
Figure 12:
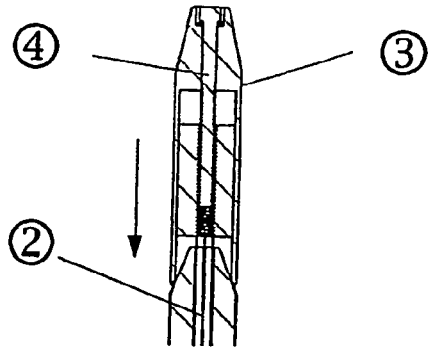

An exemplary process for adjusting and setting the wings of a centering tool is shown in FIGS. 8 through 12. FIG. 8 shows the centering tool 1 in a vertical position on the ground, for example, ready for adjustment and setting. FIG. 9 shows how the bolt 4 on top of the tool may be loosened so that the upper lock mandrel 3 is released and may travel freely (for a length of approx. 2 cm, for example) in the longitudinal direction. FIG. 10 shows how gravity will make the wings 2 fall in the direction indicated by the arrow, sliding in the sloped grooves 8 via the guiding lugs 2'. They are retained by a lower lock mandrel 5 so that the wings 2 will not fall out. Lower lock mandrel 5 is held in position by a safety nut 6 being adjustable up and down according to the desired operating diameter. FIG. 11 shows how the wings 2 may be pulled inwards by rotating the safety nut 6 inwards. By turning the safety nut 6 inwards the lower lock mandrel 5 will push the wings 2 inwards. FIG. 12 shows how the bolt 4 may be torqued in order to press upper lock mandrel 3 down towards the wings 2 and lock them in a desired position.

The invention claimed is:

1. An adjustable centering tool for use in pipes of varying inner diameter, said centering tool comprising:

a cylindrical body with an outer circumference having a plurality of longitudinal grooves, each longitudinal groove of said longitudinal grooves having first and second sloped terminations;

an upper lock mandrel;

a lower lock mandrel; and a plurality of identical and steplessly adjustable, radially protruding wings, each wing of said plurality of wings having a guiding lug and first and second chamfered end faces, wherein each wing of said wings, when fixed in a respective groove of said longitudinal grooves, is retained by said upper lock mandrel and said lower lock mandrel, said upper and lower lock mandrels engaging said first and second chamfered end faces, respectively, said first and second sloped terminations cooperating with said first and second chamfered end faces, respectively, and said respective groove cooperating with said guiding lug.

2. The adjustable centering tool of claim 1, wherein said plurality of wings is configured to be used in pipes having a first set of predetermined inner diameters, and said plurality of wings is replaceable by another plurality of wings configured for use in pipes having a second set of predetermined inner diameters, said first set of predetermined inner diameters being different from said second set of predetermined inner diameters.

3. The adjustable centering tool of claim 1, wherein said first and second chamfered end faces of said plurality of wings are configured to cooperate with said sloped first and second terminations of said longitudinal grooves, so as to enable said wings to slide in said first and second sloped terminations, and wherein said plurality of wings are capable of being synchronously locked in a position.

4. The adjustable centering tool of claim 1, wherein each of said first and second chamfered end faces has a steeper angle than each of said first and second sloped terminations relative to an axial direction.

5. The adjustable centering tool of claim 4, wherein each of said first and second chamfered end faces has an angle of 25° to the axial direction, and each of said first and second sloped terminations has an angle of 20° to the axial direction.

6. The adjustable centering tool of claim 1, wherein for each wing of said plurality of wings, each of said first and second chamfered end faces has a steeper angle than a guiding surface of said guiding lug relative to an axial direction.

7. The adjustable centering tool of claim 6, wherein each of said first and second chamfered end faces has an angle of 25° to the axial direction, and said guiding surface has an angle of 20° to the axial direction.

8. The adjustable centering tool of claim 1, wherein said upper lock mandrel includes a safety pin, and the lower lock mandrel includes a safety nut.

9. A method for adjusting an adjustable centering tool for use in pipes of varying inner diameter, wherein the centering tool has a cylindrical tool body with a plurality of longitudinal grooves configured to receive a plurality of identical and steplessly adjustable wings, each wing of said plurality of wings having guiding lugs and chamfered end surfaces, the method comprising:

positioning the centering tool in a vertical position on a drilling floor, loosening a safety pin so that an upper lock mandrel is able to travel freely in the longitudinal direction of the tool body, moving the upper lock mandrel in a direction away from the wings, adjusting a lower lock mandrel in a vertical direction so as to achieve a predetermined outer circumference of the plurality of wings, permitting the plurality of wings to slide due to gravity in sloped terminations of the grooves guided by the guiding lugs until the wings are retained by the lower lock mandrel, replacing the upper lock mandrel, and tightening the safety pin.

10. The method of claim 9, further comprising replacing the plurality of wings with another plurality of wings, wherein the plurality of wings is configured to be used in pipes having a first set of predetermined inner diameters, and the another plurality of wings is configured for use in pipes having a second set of predetermined inner diameters, the first set of predetermined inner diameters being different from the second set of predetermined inner diameters.

11. The method of claim 9, wherein said adjusting a lower lock mandrel includes adjusting a safety nut.

* * * * *